United States Patent [19]

Magiera

[11] Patent Number: 4,814,554

[45] Date of Patent: Mar. 21, 1989

[54] SWITCH ASSEMBLY WITH REDUNDANT SPRING FORCE AND ONE-PIECE PLUNGER

[76] Inventor: Joseph Magiera, 176 Acorn La., Libertyville, Ill. 60048

[21] Appl. No.: 117,503

[22] Filed: Nov. 6, 1987

[51] Int. Cl.[4] ..... H01H 5/06; H01H 21/42

[52] U.S. Cl. ..... 200/6 R; 200/437; 200/438; 200/339

[58] Field of Search ..... 200/6 R, 6 B, 6 BA, 200/6 BB, 6 C, 68.1, 68.2, 68.3, 315, 339

[56] References Cited

U.S. PATENT DOCUMENTS

| | | | |
|---|---|---|---|
| 3,413,430 | 11/1968 | Sharples | 200/68.1 |
| 3,536,872 | 10/1970 | Gilardenghi | 200/68.2 |
| 3,935,411 | 1/1976 | Ford | 200/68.2 |
| 4,335,287 | 6/1982 | Aschenbach et al. | 200/68.2 X |

FOREIGN PATENT DOCUMENTS

| | | | |
|---|---|---|---|
| 1521969 | 8/1978 | United Kingdom | 200/68.2 |

*Primary Examiner*—J. R. Scott

[57] ABSTRACT

A switch mechanism having redundant spring mechanism for use in rocker type switches. The switch mechanism has a housing which has at least an opening on a top end and a pivot mechanism on two opposing sides thereof. A pair of electrical contacts is located in a bottom end of the housing and an electrically conductive armature establishes an electrical connection between the electrical contacts. A movable rocker extends through the opening in the top end of the housing and has at least first and second opposed sides which have a structure for engaging the pivot mechanism on the housing. A one-piece plunger assembly has at least one bottom end for contacting the armature and a top end rides in a recess in the rocker. At least two coil springs are located between the top end of the plunger assembly and a bottom of the recess. One of the springs is sufficient to cause the plunger assembly to move the armature when the rocker is moved from a first position to a second position.

12 Claims, 1 Drawing Sheet

SWITCH ASSEMBLY WITH REDUNDANT SPRING FORCE AND ONE-PIECE PLUNGER

BACKGROUND OF THE INVENTION

This invention relates in general to electrical switches and, in particular, to rocker type switches having a rocker arm which typically can reside in one of two positions.

Electrical rocker switches are well known in the prior art and typically have a rocker which pivots from a first position to a second position, which thereby makes and breaks electrical contacts contained within the switch. It is known in the prior art, to utilize a spring of various configurations to act between the rocker and a plunger. The plunger contacts an electrical armature within the switch assembly and moves the armature from a first position to a second position to make and break the electrical contacts. The spring keeps the plunger in contact with the armature as the rocker is moved from the first position to the second position. Typically, the plunger has an end which contacts the armature and slides across the armature as the switching action is performed.

Furthermore, in rocker switches having a double pole configuration, it is known to use two plungers with two associated springs. If one of these springs fails, then one half of the switch becomes inoperative and the switch must be replaced.

A drawback in the prior art is that when the spring breaks or fails the switch is then inoperative. The present invention provides a solution to this problem in the prior art.

SUMMARY OF THE INVENTION

It is an objective of the present invention to provide a switch mechanism which has a redundancy of spring action between a rocker and a plunger assembly in a rocker switch to insure a redundancy within the spring mechanism for continued operation of the switch mechanism when one of the spring mechanism fails. This object is achieved by a switch mechanism which has a housing having at least an opening on a top end and a means for pivoting on two opposing sides thereof. At least one pair of electrical contacts in a bottom end of the housing is provided and at least one movable electrically conductive armature is provided for establishing an electrical connection between the pair of electrical contacts. A movable rocker extends through the opening in the top end of the housing. The rocker has at least first and second opposed sides having means for engaging the means for pivoting on the housing. A plunger assembly has at least one bottom end for contacting the armature and a top end riding in a recess in the rocker. At least two means for providing a spring force are located between the top end of the plunger assembly and a bottom of the recess in the rocker. One of the means for providing a spring force is sufficient to cause the plunger assembly to move the armature when the rocker is moved from a first position to a second position.

The switching assembly further has a slot open to the recess in the rocker in each of the two opposing sides of the rocker. The plunger assembly has first and second sides each having a tab for riding in the slots in the opposed sides of the rocker. The means for providing a spring force causes the plunger assembly to be pushed out of the recess until the tabs contact one end of the slots. The slots in the first and second sides of the rocker are longitudinally aligned with, respectively, the rocker's means for engaging said means for pivoting on the housing.

The means for providing a spring force in the preferred embodiment is a coil spring. The preferred embodiment is a double pole rocker switch utilizing two coil springs acting upon a one-piece plunger assembly having two ends for contacting two armatures. One of the coil springs is sufficient to provide proper operation of the switching assembly when the other of the coil spring is inoperative.

BRIEF DESCRIPTION OF THE DRAWINGS

The features of the present invention which are believed to be novel, are set forth with particularly in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 1:
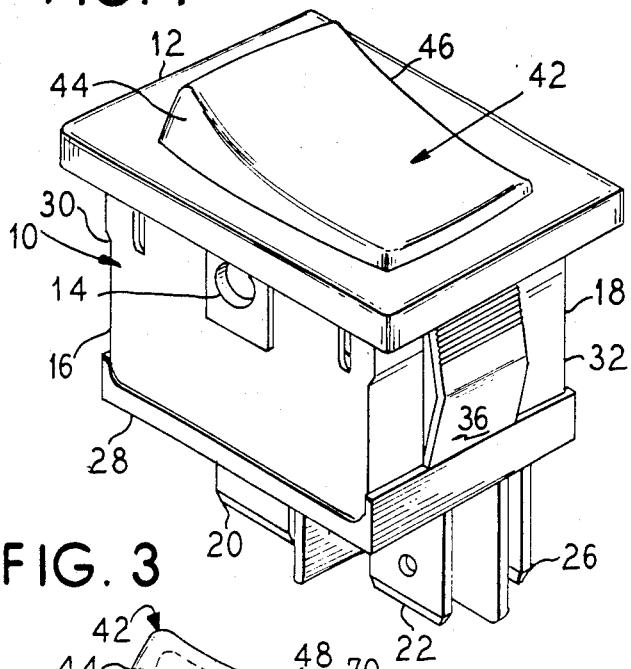
FIG. 1 is a perspective view of a switch mechanism constructed according to the present invention.

The present invention has general applicability but is most advantageously utilized in a rocker switch of the type shown in FIG. 1. Furthermore, the present invention can be utilized in a rocker switch having a single pole, double pole or multiple poles. The preferred embodiment as shown in FIG. 1 is a double pole switch.

In general terms the switch assembly has a means for providing a housing which contains a means for switching. A means for rocking partially extends through an opening in the means for providing a housing and is pivotally attached to the means for providing a housing. A means for activating the means for switching is at least partially contained within the means for rocking and is linearly movable within the means for rocking. At least two means for providing a spring force are located between the means for rocking and the means for activating. One of the means for providing a spring force is sufficient to cause the means for activating to activate the means for switching when the means for for rocking is moved from a first position to a second position.

FIG. 1 depicts in perspective view a rocker switch in which the present invention is utilized. The rocker switch has a housing 10 which has at least an open top 12 and a means for pivoting 14 on two opposing sides 16 and 18 thereof. Two pairs of electrical contacts 20, 22 and 24, 26 extend from a bottom end 28 of the housing 10.

Figure 3:
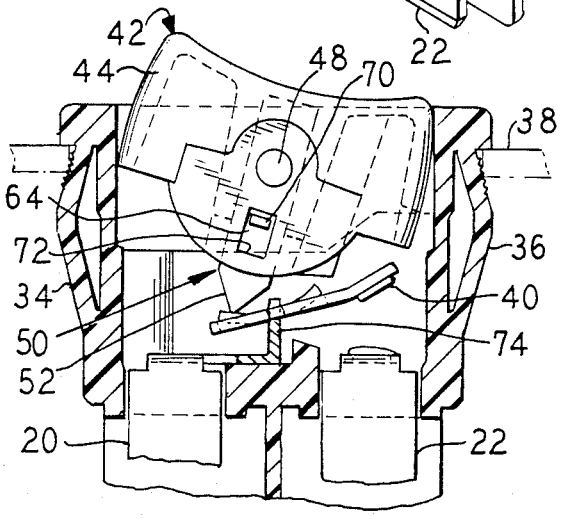
FIG. 3 is a partially cutaway side view of the FIG. 1 switch mechanism.

On opposing ends 30 and 32 of the housing 10 clips 34 and 36 are provided for securing the rocker switch to a panel 38 as can be seen in FIG. 3. Various other types of structures can be used for securing the rocker switch.

Figure 4:
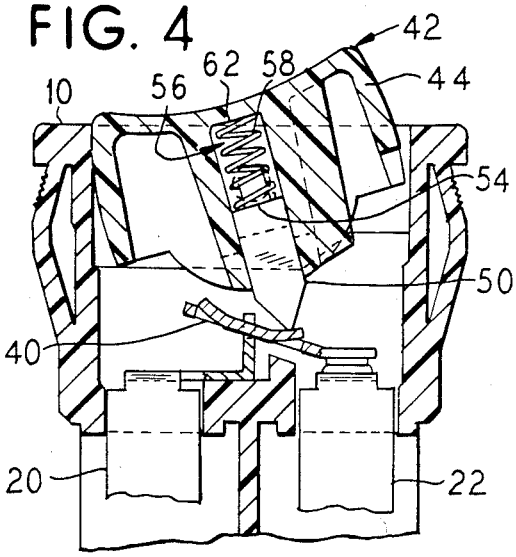
FIG. 4 is another partially cutaway side view of the FIG. 1 switch mechanism.
Figure 5:
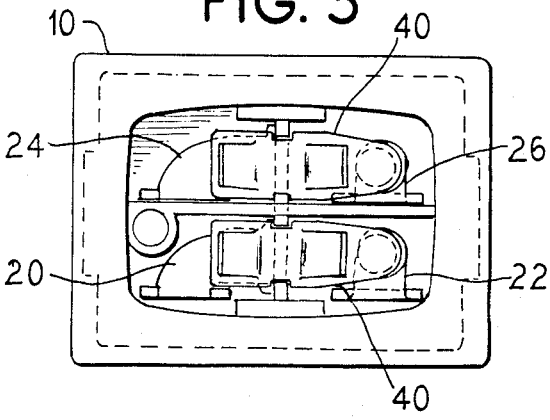
FIG. 5 is a plan view of the housing, electrical contacts and electrical armature of the FIG. 1 switch mechanism.

As can be particularly seen in FIGS. 3, 4 and 5, the switch mechanism also has at least one movable electrical conductive armature 40 for establishing an electrical connection between the pair of electrical contacts 20 and 22. A movable rocker 42 extends through the opening in the top end 12 of the housing 10. The rocker 42 has at least first and second opposed sides 44 and 46 having means 48 for engaging the means 14 for pivoting on the housing 10. A plunger assembly 50 having at least one bottom end 52 for contacting the armature 40 is provided and a top end 54 rides in a recess 56 in the rocker 42.

At least two means 58 and 60 for providing a spring force are located between the top end 54 of the plunger assembly 50 and a bottom 62 of the recess 56. One of the means 58, 60 for providing a spring force is sufficient to cause the plunger assembly 50 to move the armature 40 when the rocker 42 is moved from a first position (as shown in FIG. 3) to a second position (as shown in FIG. 4).

Each of the two opposing sides 44 and 46 of the rocker 42 has a slot 64 open to the recess 56 in the rocker 42. The plunger assembly 50 has first and second sides 66 and 68 each having a tab 70 for riding in the slot 64 of the opposed sides 44 and 46 of the rocker 42. The means for providing a spring force 58 and 60 in the preferred embodiment are coil springs. The coil springs 58 and 60 cause the plunger assembly 50 to be pushed out of the recess 56 until the tabs 70 contact one end 72 of the slots 64. This retains the plunger assembly 50 within the rocker 42 before the rocker is assembled with the housing 10. The slots 64 in the first and second sides 44 and 46 of the rocker 42 are longitudinally aligned, with respectively, the rocker 42's means 48 for engaging the means 14 for pivoting on the housing 10.

Figure 6:
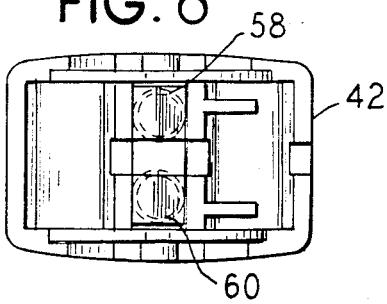
FIG. 6 is a bottom view of the rocker used in the FIG. 1 switch mechanism.

One of the contacts 20 in the bottom 28 end of the housing 10 has a raised portion 74 for supporting the armature 40, the armature 40 thereby pivots on the raised portion 74 when the rocker 42 is moved from the first position to the second position. In the preferred embodiment as can be seen for example, in FIG. 5, the rocker switch has two armatures 40 for establishing an electrical connection between the two pairs of electrical contacts 20, 22 and 24, 26. The plunger assembly is a one-piece unit having one of the two bottom ends 52 contacting one of the armatures 40 and the other bottom end 52 contacting the other armature 40. Thus, if one of the springs 58,60 were to fail, the remaining spring is sufficient to allow continued operation of both of the two bottom ends 52, since the plunger assembly 50 is a one-piece unit. The one-piece plunger assembly 50 further ensures substantially simultaneous switching of the two armatures. It is envisioned that, for example, a three pole snap switch could have a one-piece plunger assembly 50 with three bottom ends 52 and corresponding armatures 40. Also, a snap switch could utilize more than two coil springs. FIG. 5 is a plan view of the housing 10 with the rocker 42 and plunger 50 removed. FIG. 6 is a bottom view of the rocker 42 depicting the location of the two coil springs 58 and 60.

Figure 2:
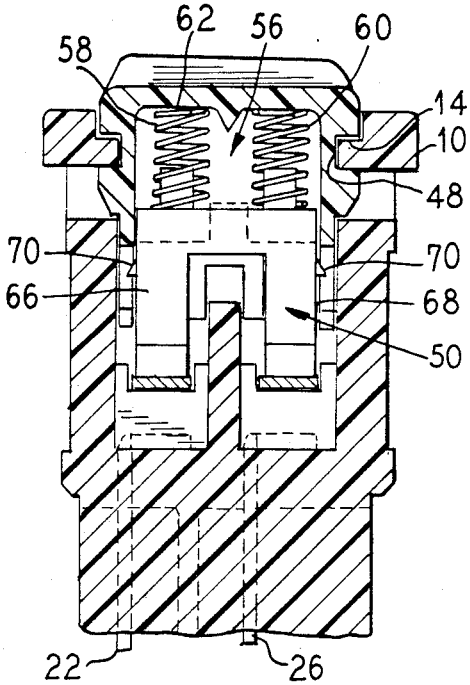
FIG. 2 is a partially cutaway end view of the FIG. 1 switch mechanism.

In the preferred embodiment, the plunger 50 has two bottom ends 52 for contacting the two armatures 40. The plunger assembly 50 is substantially U-shaped as can be seen in FIG. 2. Preferably, the bottom ends 52 of the plunger 50 have substantially triangular shaped tips for contacting the armatures 40, however, other configurations may also be utilized for other applications. In addition, as was previously stated, the rocker switch can be a single pole device, a double pole device or a multiple pole device. The advantage of the novel rocker switch of the present invention is that should one of the coil springs 58 or 60 fail or break the remaining coil spring is sufficient to allow satisfactory operation of the switch. Thus, the snap switch has a redundancy built into it which has not been found in the prior art.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A switch assembly comprising:

a housing having a least an opening on a top end and a means for pivoting on two opposing sides thereof;

at least one pair of electrical contacts in a bottom end of said housing;

at least one movable electrically conductive armature for establishing an electrical connection between said pair of electrical contacts;

a movable rocker extending through said opening in said top end of said housing, said rocker having at least first and second opposed sides having means for engaging said means for pivoting on said housing;

a one-piece plunger assembly having at least one bottom end for contacting said armature and a top end riding in a recess in said rocker;

at least two means for providing a spring force located between said top end of said plunger assembly and a bottom of said recess, one of said means for providing a spring force being sufficient to cause said plunger assembly to move said armature when said rocker is moved from a first position to a second position, said other of said means for providing a spring force being redundant when said one of said means for providing a spring force is operational and, when said one of said means for providing a spring force fails, said other of said means for providing a spring force being sufficient to cause said plunger assembly to move said armature when said rocker is moved from a first position to a second position.

2. The switch assembly according to claim 1, wherein each of said two opposing sides of said rocker has a slot open to said recess in said rocker and said plunger assembly has first and second sides each having a tab for riding in said slot of said opposed sides of said rocker, said means for providing a spring force causing said plunger assembly to be pushed out of said recess until said tabs contact one end of said slots.

3. The switch assembly according to claim 2, wherein said slots in said first and second sides of said rocker are longitudinally aligned with, respectively, said rocker's means for engaging said means for pivoting on said housing.

4. The switch assembly according to claim 1, wherein one of said contacts in said bottom end of said housing has a raised portion for supporting said armature, said armature thereby pivoting on said raised portion when said rocker is moved from said first position to said second position.

5. The switch assembly according to claim 1, wherein said means for providing a spring force is a coil spring.

6. The switch assembly according to claim 1, wherein said switch assembly has two pairs of electrical contacts in a bottom end of said housing, two movable electrically conductive armatures for establishing electrical connection between said two pairs of electrical contacts, respectively, and wherein said plunger assembly has two bottom ends for contacting said two armatures, respectively, said plunger assembly being substantially U-shaped.

7. The switch assembly according to claim 6, wherein said bottom ends of said plunger assembly have substantially triangular shaped tips for contacting said armatures.

8. A switch assembly comprising:

a housing having at least an opening on a top end and a means for pivoting on two opposing sides thereof;

at least one pair of electrical contacts in a bottom end of said housing;

at least one movable electrically conductive armature for establishing an electrical connection between said pair of electrical contacts;

a moveable rocker extending through said opening in said top end of said housing, said rocker having at least first and second opposed sides having means for engaging said means for pivoting on said housing;

a one-piece plunger assembly having at least one bottom end for contacting said armature and a top end riding in a recess in said rocker;

each of said first and second sides of said rocker having a slot open to said recess in said rocker and said plunger assembly having first and second sides each having a tab for riding in said slot of said first and second sides of said rocker, said slots in said first and second sides of said rocker being longitudinally aligned with, respectively, said rocker's means for engaging said means for pivoting on said housing; and at least two means for providing a spring force located between said top end of said plunger assembly and a bottom of said recess, one of said means for providing a spring force being sufficient to cause said plunger assembly to move said armature when said rocker is moved from a first position to a second position, said other of said means for providing a spring force being redundant when said one of said means for providing a spring force is operational and, when said one of said means for providing a spring force fails, said other of said means for providing a spring force being sufficient to cause said plunger assembly to move said armature when said rocker is moved from a first position to a second position.

9. The switch assembly according to claim 8, wherein one of said contacts in said bottom end of said housing has a raised portion for supporting said armature, said armature thereby pivoting on said raised portion when said rocker is moved from said first position to said second position.

10. The switch assembly according to claim 8, wherein said means for providing a spring force is a coil spring.

11. The switch assembly according to claim 8, wherein said switch assembly has two pairs of electrical contacts in a bottom end of said housing, two movable electrically conductive armatures for establishing electrical connection between said two pairs of electrical contacts, respectively, and wherein said plunger assembly has two bottom ends for contacting said two armatures, respectively, said plunger assembly being substantially U-shaped.

12. The switch assembly according to claim 11, wherein said bottom ends of said plunger assembly have substantially triangular shaped tips for contacting said armatures

* * * * *